US007552826B2

(12) United States Patent
Watanabe

(10) Patent No.: US 7,552,826 B2
(45) Date of Patent: Jun. 30, 2009

(54) CONTAINER FASTENER AND KNOCKDOWN CONTAINER USING THE SAME

(76) Inventor: Takahisa Watanabe, 13-12-701, Futsukaichiminami 2-chome, Chikushino-shi, Fukuoka 818-0057 (JP)

( * ) Notice: Subject to any disclaimer, the term of this patent is extended or adjusted under 35 U.S.C. 154(b) by 316 days.

(21) Appl. No.: 11/661,312

(22) PCT Filed: Jul. 29, 2005

(86) PCT No.: PCT/JP2005/013940

§ 371 (c)(1),
(2), (4) Date: Feb. 27, 2007

(87) PCT Pub. No.: WO2006/025168

PCT Pub. Date: Mar. 9, 2006

(65) Prior Publication Data

US 2007/0251857 A1 Nov. 1, 2007

(30) Foreign Application Priority Data

Aug. 31, 2004 (JP) ..... 2004-253180

(51) Int. Cl.
*B65D 19/38* (2006.01)

(52) U.S. Cl. ..... 206/600; 220/4.33; 24/457

(58) Field of Classification Search ..... 206/1.5, 206/386, 598, 600; 220/4.28, 4.29, 4.33; 24/457, 458, 287
See application file for complete search history.

(56) References Cited

U.S. PATENT DOCUMENTS 5,433,550 A * 7/1995 Huber ..... 403/348
5,862,917 A 1/1999 Noble et al.
6,216,899 B1 * 4/2001 Vicari ..... 220/1.5
6,994,226 B2 * 2/2006 Shuert ..... 220/4.29
2002/0084202 A1 * 7/2002 Nist ..... 206/386
2004/0245248 A1 * 12/2004 Shuert ..... 220/4.29
2005/0023169 A1 * 2/2005 Parsadayan ..... 206/386
2007/0194019 A1 * 8/2007 Seagle et al. ..... 220/4.08

FOREIGN PATENT DOCUMENTS

JP 11-348986 12/1999
JP 2002-114223 4/2002
JP 2002-308270 10/2002

* cited by examiner

*Primary Examiner*—Jacob K Ackun, Jr.
(74) *Attorney, Agent, or Firm*—Wenderoth, Lind & Ponack, L.L.P.

(57) ABSTRACT

A container fastener, with the use of which members such as a pallet, roof, sleeve, etc. are firmly fastened and fastening between the sleeve and the pallet and that between the sleeve and the roof are not unfastened, and an easily assembled and disassembled knockdown container using the fastener. A fastener, assembled by screwing a shank of a key (20) into a fastener body (10), is mounted on a sleeve (60), and the sleeve (60) is mounted on a pallet (70) with a rotation stop position of a knob of the key (20) adjusted so that the knob can pass through a connecting hole formed in the pallet (70). After that, the knob is rotated to advance the shank in the direction of the fastener body (10), the key is tightened by screw action until there is no play between the sleeve (60) and the pallet (70), and the rotation stop position of the knob is adjusted so that the knob does not fall out of the connecting hole. Thus, the sleeve (60) and the pallet (70) can be firmly fastened.

10 Claims, 15 Drawing Sheets

CONTAINER FASTENER AND KNOCKDOWN CONTAINER USING THE SAME

TECHNICAL FIELD

The present invention relates to a container fastener for fastening component members of a container used for shipping or storing articles, such as a pallet and a sleeve or a roof and a sleeve, as well as a knockdown container which can be assembled and disassembled using the fastener.

BACKGROUND ART

It is required that a knockdown container for shipping and storing articles be easily assembled and disassembled. Such a knockdown container mainly consists of a pallet as a base plate, a sleeve as a side frame, and a roof. A pallet has a sidewall connected to a bottom plate, and a sleeve stands on an inner side of the sidewall. A roof is placed over the sleeve making it a container for use.

An example of the above kind of container is a knockdown container described in Patent Document 1. The knockdown container consists of a pallet provided with a space on the lower side for inserting a fork of a forklift, sleeves axially connected to be foldable on each of the four sides of a bottom plate of the pallet, and a roof for closing an opening surrounded by the sleeves in a standing position. When the container is used, the sleeves are raised, the adjacent sleeves are fixed with a fixing member provided on the specific sleeve, and the roof is attached on an upper side thereof. When the container is not in use, the sleeves are folded down toward the inner side on which the canopy is attached to store the container.

Another example of a knockdown container is a container consisting of a pallet, a sleeve and a roof, which is assembled by fastening the pallet and the sleeve or the roof and the sleeve using a fastener. Such a knockdown container and a container fastener are known as described in Patent Documents 2 and 3.

The fastener described in Patent Document 2 comprises a clip pinching a lower edge of a sleeve and a substantially T-shaped locking rotary knob having a shank which is inserted into a knob housing cylinder provided on the clip. The clip is mounted on the sleeve, the sleeve is stood on an erected wall formed on the pallet, and a head portion of the locking rotary knob incorporated in the clip is pulled out through a lock hole on the erected wall to the outside of the erected wall of the pallet and rotated. Thus, the pallet and the sleeve are fastened, thereby assembling a knockdown container. With a protrusion formed on the inner surface of the knob housing cylinder on the clip, the rotation of the locking rotary knob is restricted.

The fastener described in Patent Document 3 is composed of a clip pinching a sleeve from both sides through a mounting hole formed on the sleeve and a substantially T-shaped key incorporated in the clip. The clip, while the key is incorporated therein, is mounted to the sleeve, a handle of the key is inserted into a connecting hole formed on the pallet, and the handle of the key which projects through the connecting hole is turned 90 degrees to lock the key to inhibit it from falling out from the connecting hole. Thus, the pallet and the sleeve are fastened, thereby assembling a knockdown container. The rotation of the key is restricted by a rib formed on the clip.

Patent Document 1: Unexamined Japanese Patent Publication No. 2002-114223

Patent Document 2: Unexamined Japanese Patent Publication No. H11-348986

Patent Document 3: U.S. Pat. No. 5,862,917

DISCLOSURE OF THE INVENTION

Problems to be Solved by the Invention

The knockdown container described in Patent Document 1 can be easily assembled by fixing the raised sleeves with the fixing member and easily disassembled by removing the fixing member. However, as the pallet and the sleeves cannot be separated, each of the sleeves has to be folded down toward the inner side when the container is not in use. Therefore, the container takes up a great deal of space, leading to inefficient storage or shipping of the container. Furthermore, if either of the sleeve or the pallet is broken, the whole container has to be replaced by a new one, which means a wasteful expenditure of money.

In the knockdown container described in Patent Documents 2 and 3, the pallet, the sleeve and the roof are formed as separate components. Therefore, as long as each component has a portion with which a fastener can be engaged for fastening the components, the shape of other portions can be optionally selected, thereby providing a versatile knockdown container. In addition, when the container is not in use, other components than the pallet can be collected by stacking them on the pallet or the components can be sorted and bundled according to type, improving the storage efficiency when storing or shipping the container. Moreover, the components can be easily replaced when they are broken. Additionally, once the pallet and the sleeve are fixed, the rotation of the locking rotary knob or the key is restricted so that the pallet and the sleeve are not released while using the container.

Nevertheless, the knockdown container using the fastener described in Patent Documents 2 and 3 has the following disadvantages. In the fastener of Patent Document 2, as the movement of the shank of the locking rotary knob is not restricted in its axial direction, the connection between the pallet and the sleeve is loosened, leading to an unstable knockdown container with considerably weak connection.

The shank of the fastener of Patent Document 3 is longer than the distance from the fastener body to the connecting hole formed on the pallet with some allowance in order to facilitate checking of the fastener with eyes and the rotation of the key for locking and releasing. On the other hand, this allowance may cause the sleeve and the pallet to be loosened and lead to the same problem as the one of the fastener described in Patent Document 2.

When disassembling the knockdown container using the fastener described in Patent Document 3, the key is rotated in order to pull out the handle of the key incorporated into the clip mounted on the sleeve from the connecting hole formed on the pallet. Then, the clip is pressed by the cargo loaded thereon. Thus, since two flanges of the key are also pressed in a lateral direction, a problem is presented in that the handle of the key cannot be rotated without using a tool such as nippers.

In view of the foregoing problems, an object of the present invention is to provide a container fastener, with the use of which members such as a pallet, roof, sleeve, etc. are easily and firmly fastened, and fastening between the sleeve and the pallet and that between the sleeve and the roof are not unfastened while using the container, as well as an easily assembled and disassembled knockdown container using the fastener.

Means for Solving the Problems

A container fastener of the present invention comprises a fastener body which is mounted on a sleeve of a knockdown container provided with a pallet, a sleeve, and a roof and an auxiliary fastener which is incorporated into the fastener body to be advanceable to and retractable from the fastener body, in which a shank of the auxiliary fastener is held by the fastener body; a knob formed on a base end of the shank passes through or does not pass through a connecting hole formed on the pallet or the roof depending on a rotation stop position of the knob; and the pallet and the sleeve or the roof and the sleeve are connected or separated depending on the rotation stop position of the knob of the auxiliary fastener, wherein the fastener body comprises a plate-like base member provided thereon with a fixing portion for fixing the fastener body to the sleeve through a mounting hole formed on the sleeve, a screw portion for controlling advance and retraction of the auxiliary fastener, and a restricting portion for preventing a rotation of the auxiliary fastener, the screw portion having an internal thread which corresponds to an external thread formed on the shank of the auxiliary fastener, and the restricting portion having a restricting member for preventing free rotation of the auxiliary fastener by elastically restricting a part of the shank, and the part of the shank of the auxiliary fastener has a form which corresponds to the restricting member of the fastener body.

According to the fastener of the present invention, a sleeve and a pallet or a sleeve and a roof are firmly fastened by the following steps: the fastener, assembled by screwing a shank of an auxiliary fastener into a fastener body, is mounted on the sleeve through a mounting hole, and the sleeve is mounted on the pallet or the roof with a rotation stop position of a knob of the key adjusted so that the knob can pass through a connecting hole formed in the pallet or the roof. After that, the knob is rotated to gradually advance the shank in the direction of the fastener body, the auxiliary fastener is tightened until there is no play between the sleeve and the pallet or the roof, and the rotation stop position of the knob is adjusted to prevent the knob from falling out from the connecting hole. Here, since a part of the shank of the auxiliary fastener is elastically restricted by the restricting member of the restricting portion formed on the fastener body, the auxiliary fastener is prevented from free rotation. Therefore, the auxiliary fastener does not rotate in a normal operation, preventing the fastened members from loosening or falling out. In this case, the restricting member provided on the fastener body elastically prevents free rotation of the auxiliary fastener and, by forcibly rotating the knob, the auxiliary fastener can be rotated against the restricting force. It is thus possible to control the advance and retraction of the shank or to adjust the rotation stop position of the knob. When separating the fastened sleeve and pallet or the fastened sleeve and roof, the knob can pass through the connecting hole formed on the pallet or the roof simply by adjusting the rotation stop position of the knob, facilitating the separating operation. Here, it should be noted that the mounting hole in the present invention does not only mean a through hole but also means a notch formed on the sleeve.

Depending on the way of mounting the fastening body to the sleeve, the fastening body may have the following forms. A first example to be employed may be a fastening body wherein the base member is a single plate; the fixing portion has a fixing tab with an L-shaped section projecting from the plate, which hooks and is fixed to a lower edge of the mounting hole formed on the sleeve; and the restricting member projects from the plate in the restricting portion and has a flat surface which prevents free rotation of the auxiliary fastener by planar contact with a flat surface formed on the part of the shank of the auxiliary fastener. The fixing tab which has an L-shaped section can easily hook and be fixed to the lower edge of the mounting hole of the sleeve. Furthermore, with the restricting member projecting from the plate in the restricting portion, free rotation of the shank of the auxiliary fastener is prevented by the restricting member. If the knob is forcibly rotated, the auxiliary fastener can be rotated against the restricting force, thereby controlling the advance and retraction of the shank and adjusting the rotation stop position of the knob. The restricting member may have any shape except its flat surface as long as the restricting member has planar contact with the flat surface formed on the part of the shank of the auxiliary fastener.

A second example to be employed may be a fastener body wherein the base member of the fastener body is a plate which is foldable on both sides of a central portion of the base member; the fixing portion has engaging tabs projecting from a pair of planar sections which face each other when the plate is folded, the engaging tabs being elastically engaged with each other through a mounting hole formed on the sleeve and fixed to the sleeve; and the restricting member of the restricting portion projects from the pair of planar sections and has a flat surface which prevents free rotation of the auxiliary fastener by planar contact with a flat surface formed on the part of the shank of the auxiliary fastener. The fastener body can be easily mounted to the sleeve simply by folding the pair of planar sections interposing the sleeve therebetween and pressing the engaging tabs formed on the planar sections to each other through the mounting hole. With the restricting members projecting from the pair of planar sections in the restricting portions, free rotation of the shank of the auxiliary fastener is prevented by the restricting members. If the knob is forcibly rotated, the auxiliary fastener can be rotated against the restricting force, thereby controlling the advance and retraction of the shank and adjusting the rotation stop position of the knob. The restricting members may have any shape except their flat surfaces as long as the restricting members have planar contact with the flat surface formed on the part of the shank of the auxiliary fastener.

Preferably, the shank of the auxiliary fastener may have a flat surface which is formed on a front end side or a rear end side of the external thread and corresponds to the flat surface of the restricting member of the base member. When the auxiliary fastener is rotated, a corner of the flat surface formed on the shank outwardly presses the flat surface formed on the restricting member to elastically deform the base member at a foot portion of the restricting member. The restricting member has a resilience to restore the original position from this deformation, which serves as a resistance against the rotation of the shank of the auxiliary fastener, thereby elastically restricting the shank of the auxiliary fastener. Thus, free rotation of the auxiliary fastener is prevented so that the auxiliary fastener does not rotate in a normal operation. Preferably, the thickness of the base member at the foot portion of the restricting member may be smaller than the thickness of the portion surrounding the foot portion. By this structure, the base member is easily elastically deformed at the foot portion of the restricting member and, therefore, any tool or the like is not necessary to forcibly rotate the knob. The shank of the auxiliary fastener may have any shape except its flat surface as long as the shank has planar contact corresponding with the flat surface formed on the restricting member.

A knockdown container of the present invention is a knockdown container comprising a pallet, a sleeve and a roof, wherein the sleeve has a mounting hole to which the above-described fastener body is mounted; at least one of either the pallet or the roof has a connecting hole through which the above-described auxiliary fastener passes; and at least one of either the pallet or the roof is attachable to or detachable from the sleeve with the above-described container fastener. Therefore, it is possible to obtain a knockdown container which can be easily assembled and disassembled, in which the connection between the sleeve and the pallet or the connection between the sleeve and the roof is not loosened while using the container.

Advantages of the Invention (1) According to the fastener of the present invention, the sleeve and the pallet or the sleeve and the roof can be easily and firmly fastened to be fixed and easily detached simply by adjusting the screwed connection between the fastener body and the auxiliary fastener and the rotation stop position of the knob. The screwed connection also enables fine control of the connecting condition between the sleeve and the pallet and the sleeve and the roof. Furthermore, since free rotation of the auxiliary fastener is controlled, the auxiliary fastener does not rotate in a normal operation, preventing the fastened members from loosening or falling out. Accordingly, the connected sleeve and pallet or the connected sleeve and roof are not separated during the use of the container.

(2) In the fastener body, the base member is a single plate, the fixing portion has a fixing tab with an L-shaped section projecting from the plate, which hooks and is fixed to a lower edge of the mounting hole formed on the sleeve, and the restricting member projects from the plate in the restricting portion and has a flat surface which prevents free rotation of the auxiliary fastener by planar contact with a flat surface formed on the part of the shank of the auxiliary fastener. By this structure, the fastener body can be easily mounted on the sleeve simply by forming a notch on the sleeve, and the auxiliary fastener does not rotate to loosen or unfasten the connection in a normal operation. Thus, the members such as the pallet, the sleeve and the roof can be easily and firmly fastened while preventing the connection between the sleeve and the pallet and between the sleeve and the roof from breaking.

(3) In the fastener body, the base member of the fastener body is a plate which is foldable on both sides of a central portion of the base member, and the fixing portion has engaging tabs projecting from a pair of planar sections which face each other when the plate is folded, the engaging tabs being elastically engaged with each other through a mounting hole formed on the sleeve and fixed to the sleeve. By this structure, it is also possible to easily mount the fastener body to the sleeve, and the auxiliary fastener does not rotate to loosen or unfasten the connection in a normal operation. Thus, the members such as the pallet, the sleeve and the roof can be easily and firmly fastened, preventing the connection between the sleeve and the pallet and between the sleeve and the roof from breaking.

(4) The fastener of the present invention can easily and firmly fasten or easily detach the sleeve and the pallet or the sleeve and the roof simply by adjusting the screwed connection between the fastener body and the auxiliary fastener and the rotation stop position of the knob without requiring a tool. It is, therefore, possible to obtain a knockdown container capable of easy assembly and disassembly. In addition, if one of the pallet, the sleeve or the roof is broken, only the broken member need be replaced, eliminating a wasteful expense. Moreover, when the container is not in use, other components than the pallet can be collected by stacking them on the pallet or the components can be sorted and bundled according to type, improving the storage efficiency when storing or shipping the container.

EXPLANATION OF REFERENCE NUMERALS

Figure 1:
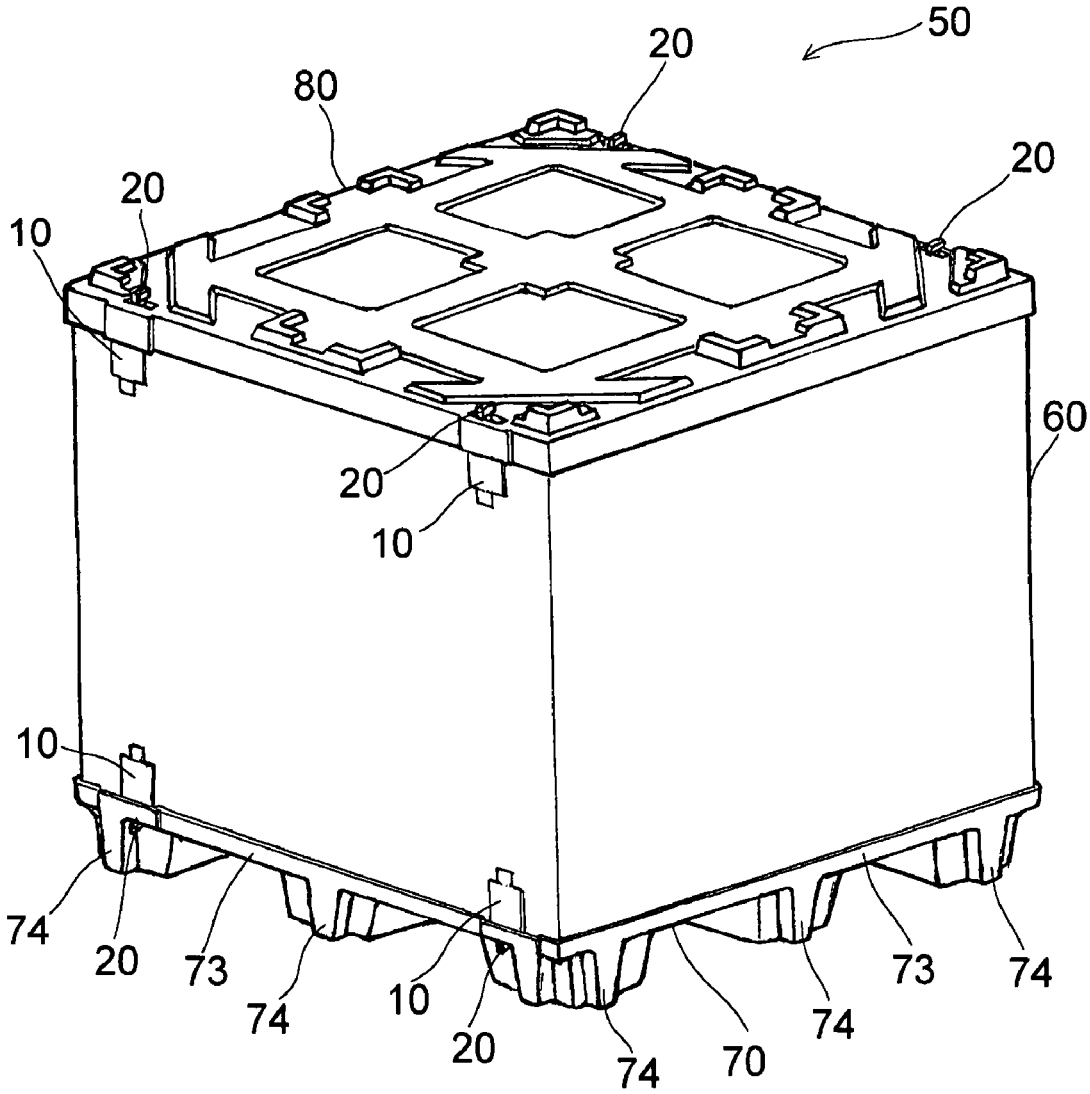
[FIG. 1] is a perspective view of a knockdown container using a container fastener of a first embodiment of the present invention.

10, 100: fastener body
20: key
21: shank
21*a*: external thread portion
21*b*: square rod portion
22: knob
22*a*: flange
30: lower plate member
40: upper plate member
41: pull-tab
42, 120, 130: fixing portion
31, 107: screw portion
32, 108: internal thread
33, 133: restricting member
34, 134: restricting portion
35: engaging tab
45: fixing tab
35*a*, 45*a*: connecting portion
35*b*: contacting portion
45*b*: hook portion
50, 150: knockdown container
60, 160: sleeve
61, 161: mounting hole
62, 162: notch
70: pallet

71, 81: connecting hole
73: sidewall
74: leg
80: roof
103: inner side plate
104: outer side plate
105: hinge
106: connecting portion
107*a*, 107*b*: pair arms
109*a*, 109*b*: fitting portion
110: spacer
111: intermediate wall
112: opening portion
113 inner engaging tab
114: claw guiding portion
115: concave portion
116: convex portion
117: outer engaging tab
118: arm
119: claw

BEST MODE FOR CARRYING OUT THE INVENTION

First Embodiment

Referring to the accompanied drawings, a first embodiment of the present invention is explained below. FIG. 1 is a perspective view of a knockdown container using a container fastener of the first embodiment of the present invention; and FIG. 2 is an exploded perspective view of the knockdown container.

Figure 2:
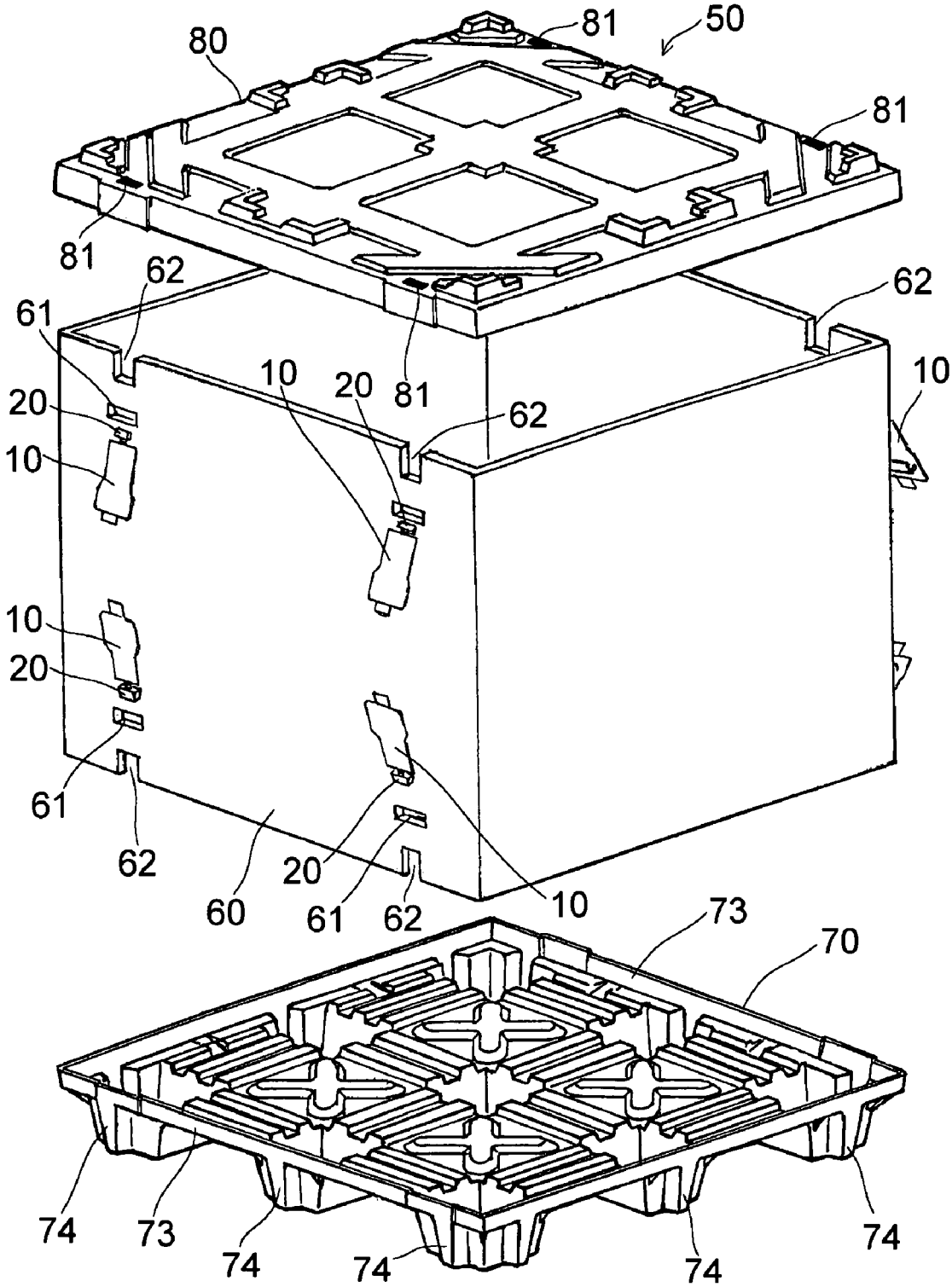
[FIG. 2] is an exploded perspective view of the knockdown container.

As shown in FIGS. 1 and 2, a knockdown container 50 is assembled by fastening a pallet 70, a sleeve 60 and a roof 80 with fasteners. The pallet 70 is provided with a sidewall 73 connected to and rising from a bottom plate and a plurality of legs 74 expanding downward. On the legs 74, each of which is formed on each corner of the pallet 70, rectangular-shaped connecting holes 71 (see FIG. 5), into which a key 20 as an auxiliary fastener of the container fastener of the first embodiment is insertable, are formed on a pair of sides of the pallet 70 facing each other and inside a sidewall 73. Also on the roof 80, connecting holes 81 into which the key 20 is insertable are formed as in the pallet 70.

On the sleeve 60, rectangular-shaped mounting holes 61 for mounting a fastener body 10 of the container fastener of the first embodiment are formed on a pair of sleeves 60 facing each other. The positions of the mounting holes 61 correspond to the connecting holes 71 and 81 of the pallet 70 and the roof 80, respectively. On an edge of the sleeve 60 on which each of the mounting holes 61 is formed, notches 62 are provided, into which the fastener body 10 of the container fastener of the first embodiment is partially inserted.

Figure 3A:
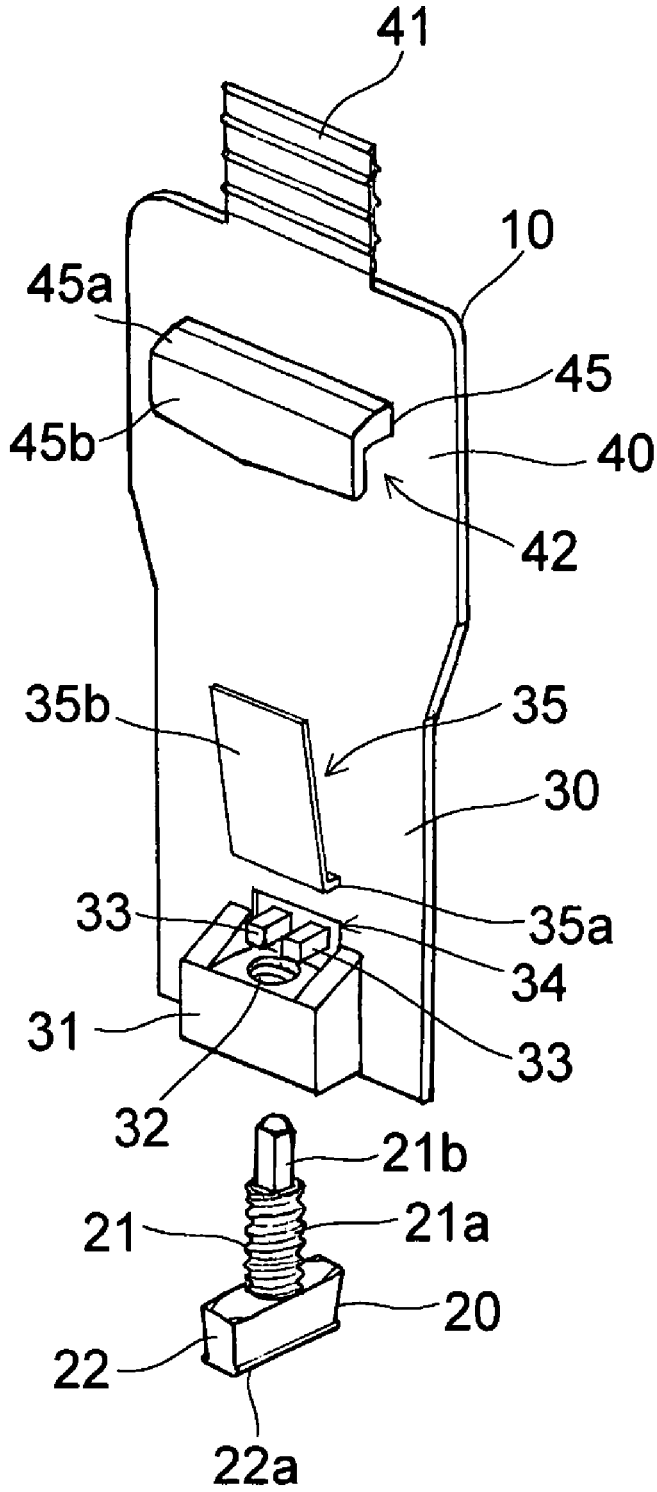
[FIG. 3A] is a perspective view illustrating a fastener body and a key of the container fastener of the first embodiment, respectively.
Figure 3B:
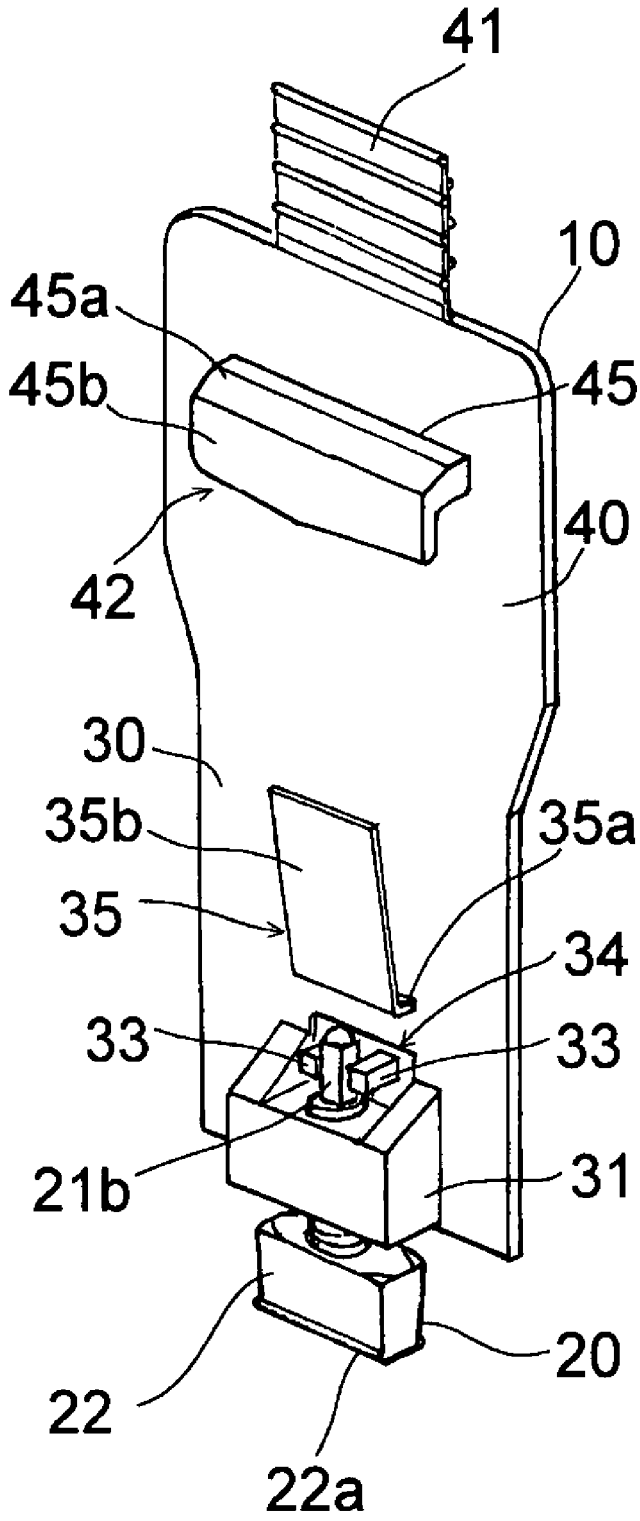
[FIG. 3B] is a perspective view illustrating a screwed condition of the key of the container fastener of the first embodiment into the fastener body.

Next, the container fastener of the first embodiment is explained referring to FIG. 3. FIG. 3A is a perspective view illustrating the fastener body 10 and the key 20 of the container fastener of the first embodiment, respectively; and FIG. 3B is a perspective view illustrating a screwed condition of the key 20 of the container fastener of the first embodiment into the fastener body 10.

As shown in FIG. 3, the container fastener of the first embodiment consists of the fastener body 10 and the key 20 which is the auxiliary fastener. A base member of the fastener body 10 is a single plate having a substantially rectangular shape. The base member is integrally formed with an upper plate member 40 and a lower plate member 30 which has a smaller width than the upper plate member 40, and the width of the base member is formed to gradually decrease in width from the upper plate member 40 to the lower plate member 30.

A fixing portion 42 for fixing the fastener body 10 to the sleeve 60 via the mounting hole 61 formed on the sleeve 60 is provided at a central portion of the upper plate member 40 of the fastener body 10, and a screw portion 31 for controlling advance and retraction of the key is provided on a lower end of the lower plate member 30.

In the fixing portion 42, a fixing tab 45 with an L-shaped section consisting of a connecting portion 45*a* and a hook portion 45*b* projects from the upper plate member 40. The connecting portion 45*a* of the fixing tab 45 has a slightly shorter projecting length than the thickness of the sleeve 60, and the hook portion 45*b* is joined to the connecting portion 45*a* with an angle of approximately 90 degrees. By hooking the fixing tab 45 on the mounting hole 61 of the sleeve 60, the fixing tab 45 is fixed while pinching the sleeve 60. Thus, the fastener body 10 can be firmly fixed to the sleeve 60.

In the screw portion 31 having a substantially rectangular parallelepiped shape, an internal thread 32 is formed for screwing the key 20 in the same direction as a vertical direction of the fastener body 10. Above the screw portion 31, a restricting portion 34 for preventing rotation of the key 20 is formed on the lower plate member 30. In the restricting portion 34, square rod-shaped restricting members 33 perpendicularly project from the lower plate member 30 for preventing free rotation of the key 20 by elastically restricting the shank of the key 20. Here, the thickness of the lower plate member 30 at a foot portion of the restricting member 33 is formed to be smaller than the thickness of a surrounding area of the plate.

On an upper edge of the upper plate member 40, a bendable thin-walled pull-tab 41 is formed. The pull-tab 41 is provided with ridges formed thereon for preventing fingers from slipping off when pulling the pull-tab 41. Around a center of the lower plate member 30 and above the restricting portion 34, an engaging tab 35 which is inserted into the notch 62 on the sleeve 60 when assembling a container is formed. The engaging tab 35 has a substantially L-shaped section consisting of a connecting portion 35*a* and a contacting portion 35*b* and is formed to face the fixing tab 45 as mentioned above. A projecting length of the connecting portion 35*a* of the engaging tab 35 is shorter than the thickness of the sleeve 60, and the contacting portion 35*b* is formed to have a slightly shorter length than the length from the connecting portion 35*a* to an edge of the notch 62 when the engaging portion 35 is inserted into the notch 62. The engaging portion 35 is so formed as to be housed in the notch 62.

The key 20 incorporated into the fastener body 10 to be advanceable and retractable has a T-shape consisting of a shank 21 which is threadably engageable with the internal thread 32 formed on the screw portion 31 of the fastener body 10 and a knob 22 having a substantially rectangular parallelepiped shape which is connected to a base end of the shank 21. The shank 21 is provided with an external thread portion 21*a* formed to correspond to the internal thread 32 and a square rod portion 21*b* on a front side thereof. A tip end of the square rod portion 21*b* has a hemispheric form so that the shank 21 can be easily inserted. Four corners of a surface on a shank side of the knob 22 are cut off in order to reduce contact resistance by rotation. On an opposite side thereof, a flange 22*a* for retraction is formed to allow a retracting force to be easily applied when rotating the key 20 counterclockwise.

Figure 4A:
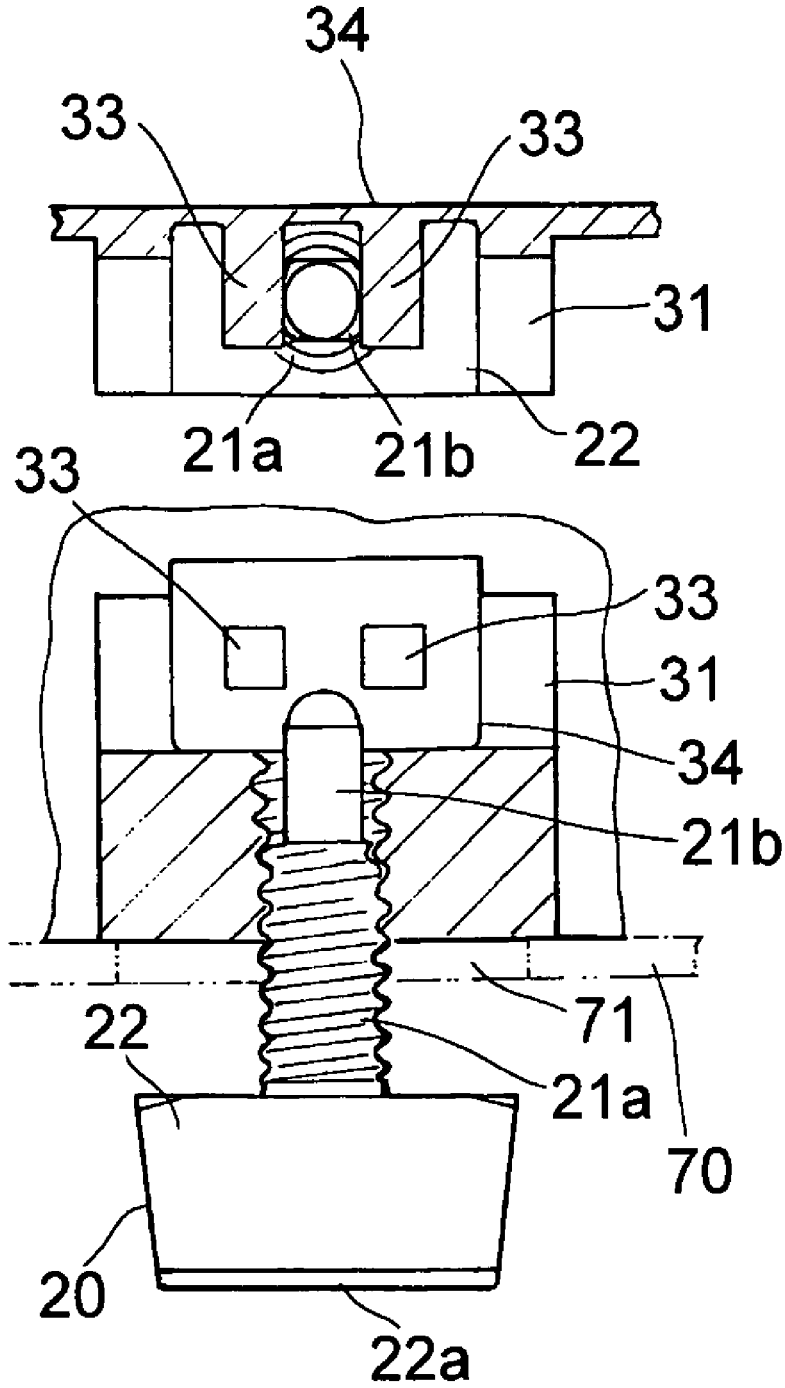
[FIG. 4A] is a plan view and a sectional view which illustrate a shank of the key and a restricting member before engaging.
Figure 4B:
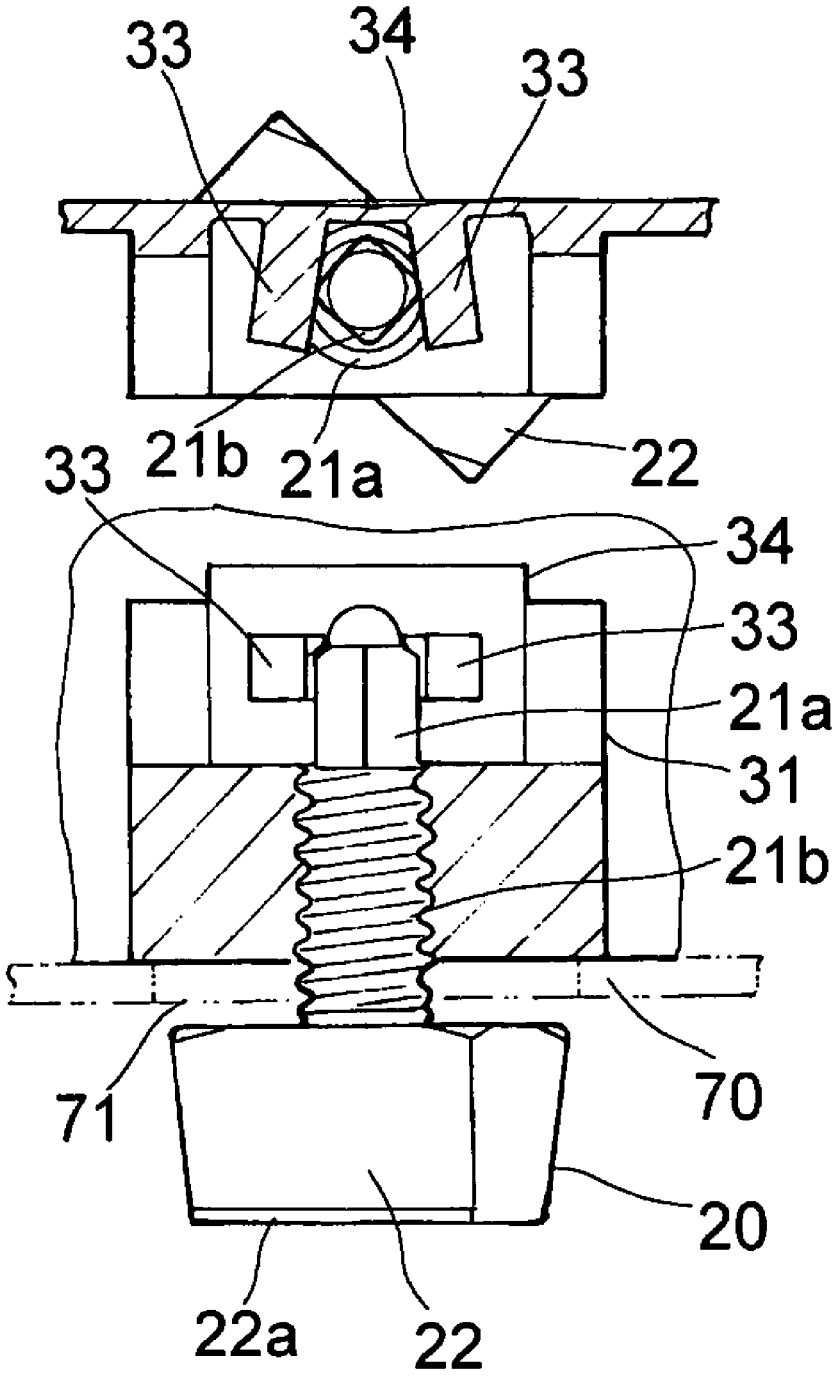
[FIG. 4B] is a plan view and a sectional view which illustrate the shank of the key and the restricting member while being engaged.
Figure 4C:
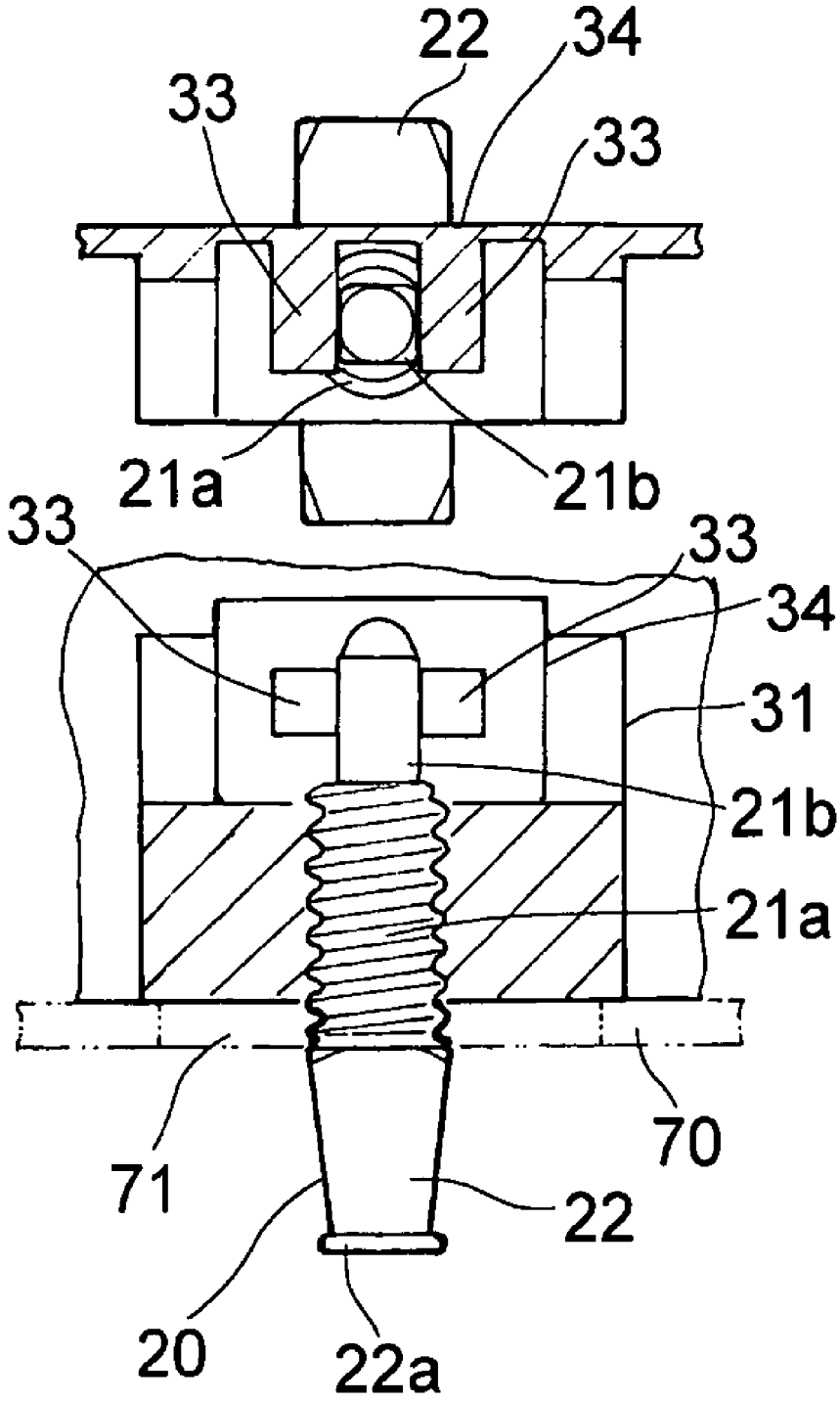
[FIG. 4C] is a plan view and a sectional view which illustrate the shank of the key and the restricting member after engaging.

A function of the key 20 during rotation is explained below referring to FIG. 4. FIG. 4A is a plan view and a sectional view which illustrate the shank 21 of the key 20 and the restricting member 33 before engaging; FIG. 4B is a plan view and a sectional view which illustrate a state while being engaged; and FIG. 4C is a plan view and a sectional view which illustrate a state after engaging.

The shank 21 of the key 20 is screwed into the internal thread 32 of the screw portion 31 and moved forward by rotating the knob 22. Then, as shown in FIG. 4A, the hemispheric tip end of the shank 21 is inserted between the restricting members 33. Here, both sides of the square rod portion 21*b* tightly contact with the restricting members 33 by planar contact, thereby pinching the square rod portion 21*b* between the restricting members 33. When the knob 22 is further rotated about 45 degrees, as shown in FIG. 4B, the restricting members 33 are pushed outwardly by a corner of the square rod portion 21*b*, and the plate at the foot portion of the restricting members 33 is elastically deformed. Then, resilience of the restricting members 33 to restore the original position serves as a resistance against the rotation of the key 20 on the square rod portion 21*b*. Thus, the shank 21 of the key 20 has a mechanism to be elastically restricted (see FIG. 4C). In the first embodiment, the square rod portion 21*b* of the key 20 is provided on the front side of the external thread 21*a*. However, as long as the above-described function can be obtained, the square rod portion 21*b* may be provided on a rear side of the external thread 21*a*. In this case, the restricting members 33 of the fastener body 10 are to be disposed at a position corresponding to the square rod portion 21*b*.

Figure 5A:
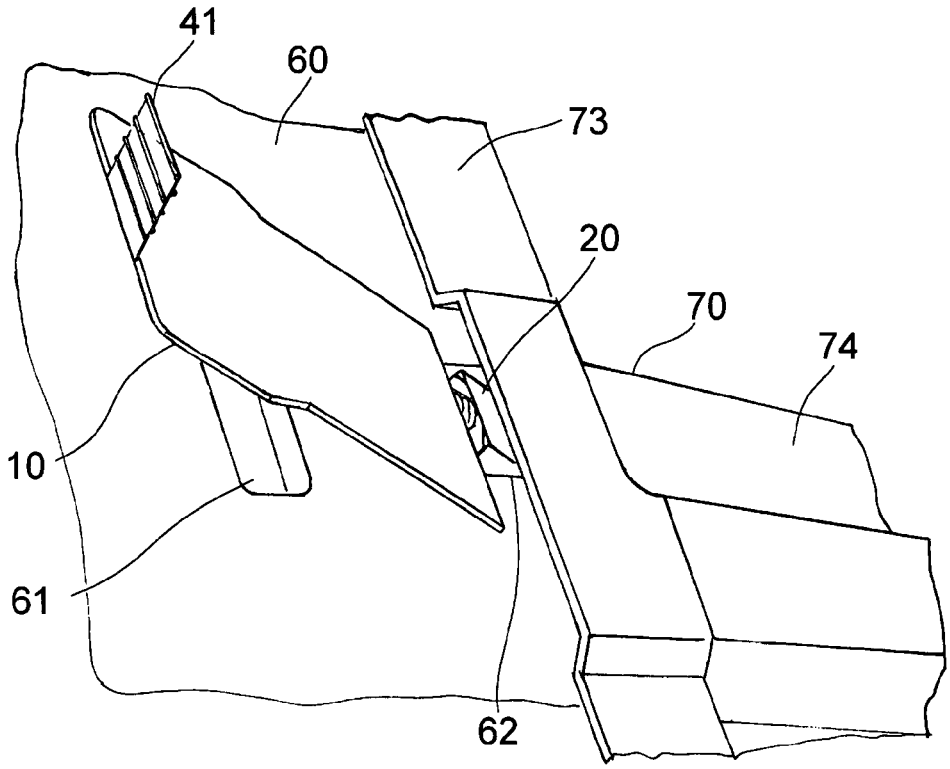
[FIG. 5A] is a perspective view illustrating the container fastener of the first embodiment being mounted on a sleeve.
Figure 5B:
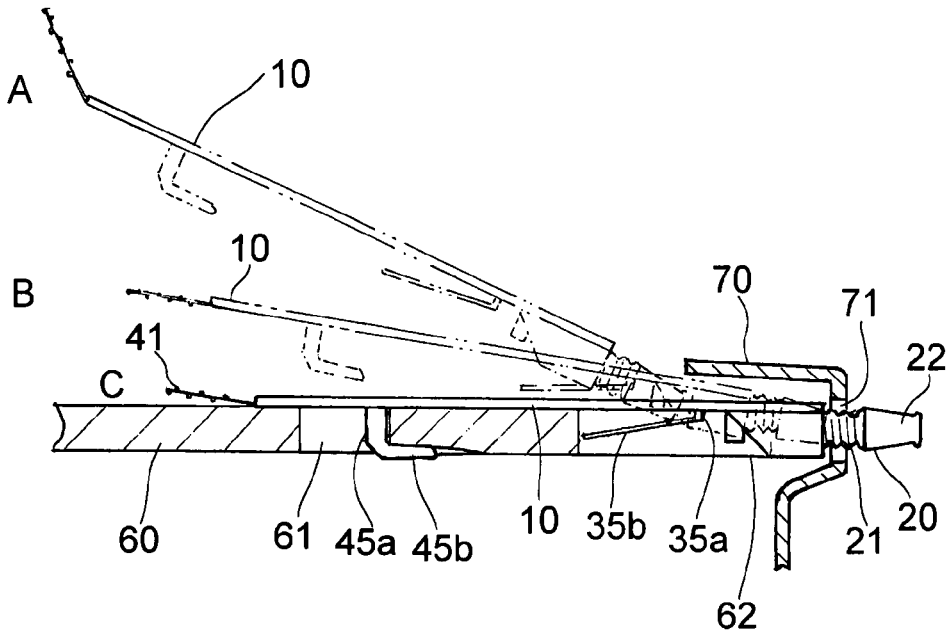
[FIG. 5B] is a sectional view illustrating the container fastener of the first embodiment being mounted on a sleeve.

Next, a method of assembling a knockdown container 50 using the container fastener described in the first embodiment is explained below with reference to the drawings. FIG. 5A is a perspective view illustrating the container fastener of the first embodiment being mounted on a sleeve; and FIG. 5B is a sectional view thereof.

Firstly, the shank 21 of the key 20 is screwed into the internal thread 32 of the screw portion 31 of the fastener body 10 to mount the key 20 to the fastener body 10. Here, the key 20 is screwed to the extent that the key 20 does not fall off the fastener body 10. Rotation is adjusted so that a longitudinal direction of the knob 22 of the key 20 is in parallel to the base member of the fastener body 10, or that the key 20 can be inserted into the connecting holes 71 formed on the pallet 70.

Next, the sleeve 60 is put on the inner side of the sidewall 73 of the pallet 70. Then, as illustrated by FIG. 5A and A and B in FIG. 5B, the fastener body 10 is slanted with the knob 22 of the key 20 being inserted into the notch 62 of the sleeve 60 so that the hook portion 45*b* of the fixing tab 45 of the fastener body 10 passes through the mounting hole 61 of the sleeve 60 and is fixed to the sleeve 60. As illustrated by C in FIG. 5B, after confirming that the hook portion 45*b* of the fixing tab 45 of the fastener body 10 has been hooked on the sleeve 60 and fixed, the knob 22 of the key 20 is inserted until the knob 22 passes through the connecting hole 71 formed on the pallet 70. Here, the engaging tab 35, the screw portion 31 and the restricting portion 34 of the fastener body 10 are housed in the notch 62.

After the knob 22 of the key 20 passes through the connecting hole 71 on the pallet 70, the knob 22 is rotated and tightened up. Then, as shown in FIG. 4, with the pallet 70 pinched between the fastener body 10 and the key 20, the knob 22 is rotated and tightened up until the sleeve 60 and the pallet 70 are firmly fastened without any play therebetween. During the rotation, the shank of the key 20 is elastically restricted by the restricting members 33 to cause a resistance against the rotation. However, the thickness at the foot portion of the restricting members 33 is smaller than the thickness of the surrounding area, allowing easy elastic deformation and, therefore, the knob 22 can be smoothly rotated by hand without requiring a tool or injuring one's fingers. Furthermore, as the four corners of the surface on the shank side of the knob 22 are cut off in order to reduce the contact resistance with the pallet 70 due to rotation, the knob 22 can be rotated and tightened up to the final state by hand.

Then, as shown in FIG. 4C, the rotation stop position of the knob 22 is adjusted to be perpendicular to the connecting hole 71, thereby fastening the sleeve 60 and the pallet 70. The fixing tab 45 and the engaging tab 35 of the fastener body 10 are mounted on the sleeve 60 facing each other. Accordingly, in the fastener body 10, if the sleeve 60 is strained in a horizontal direction or pulled away in a vertical direction, the fastener body 10 hardly falls off the sleeve 60, realizing the firmly fixed knockdown container 50.

For connecting the sleeve 60 and the roof 80, the above-described method can be employed. That is, the fastener body 10 into which the key 20 is screwed is mounted on the sleeve 60, and the knob 22 is projected from the connecting hole 81 of the roof 80. In this manner, it is possible to provide the knockdown container 50 in which the sleeve 60 and the pallet 70 as well as the sleeve 60 and the roof 80 are firmly fastened.

While the knockdown container is in use, the shank 21 of the key 20 is prevented from free rotation by the restricting members 33 of the fastener body 10. Therefore, the key 20 does not rotate in a normal operation. Thus, the connection between the pallet 70 and the sleeve 60 or between the roof 80 and the sleeve 60 does not loosen, and the knob 22 does not fall out of the connecting holes 71 or 81 preventing the breakup of the pallet 70 and the sleeve 60 or the roof 80 and the sleeve 60.

The pallet 70 and the sleeve 60 or the roof 80 and the sleeve 60 can be easily separated simply by adjusting the rotation stop position of the knob 22 so as to pull out the knob 22 from the connecting holes 71 and 81. Therefore, it is possible to realize the knockdown container which is not only easily assembled but also easily disassembled.

Second Embodiment

Figure 6:
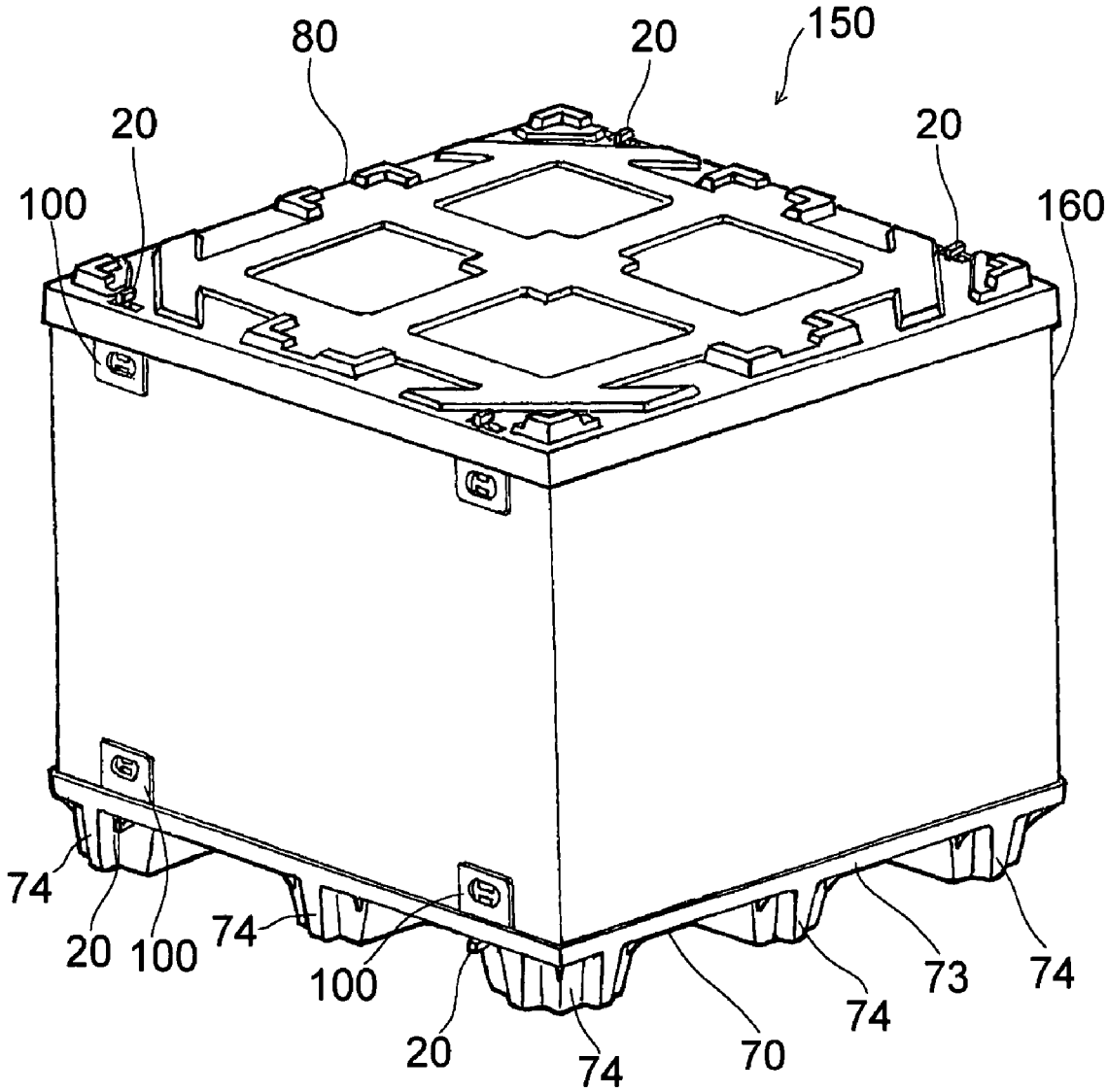
[FIG. 6] is a perspective view of a knockdown container using a container fastener of a second embodiment of the present invention.

Next, a second embodiment of the present invention is explained referring to the accompanied drawings. FIG. 6 is a perspective view of a knockdown container using a container fastener of the second embodiment of the present invention; and FIG. 7 is a drawing illustrating a fastening process in which the container fastener of the second embodiment is mounted on a sleeve.

As shown in FIG. 6, a knockdown container 150 of the second embodiment is composed by connecting the pallet 70, a sleeve 160 and the roof 80 with fasteners. As the pallet 70 and the roof 80 are the same as the pallet 70 and the roof 80 in the first embodiment, their explanation is omitted by assigning the same reference numerals.

Figure 7:
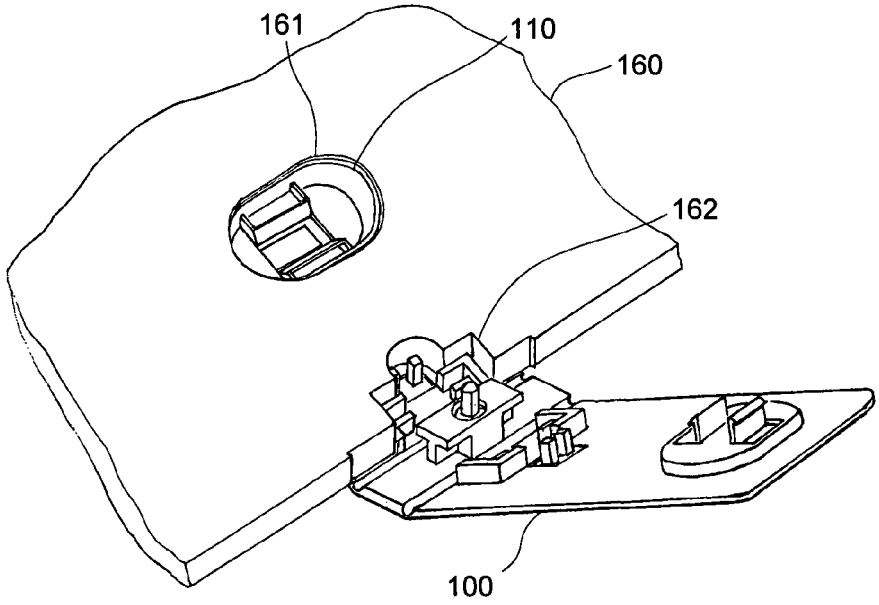
[FIG. 7] is a drawing illustrating a fastening process in which the container fastener of the second embodiment is mounted on a sleeve.

As shown in FIG. 7, in the sleeve 160, mounting holes 161 with an oval shape are formed on a pair of sleeves 160 facing each other for mounting a fastener body 100 of the container fastener of the second embodiment. The positions of the mounting holes 161 correspond to the connecting holes 71 and 81 in the pallet 70 and the roof 80, respectively. On an edge of the sleeve 160 with each of the mounting holes 161 formed therein, a notch 162 is formed for receiving a part of the fastener body 100 of the container fastener of the second embodiment. The notch 162 has a shape corresponding to the fastener body 100.

Figure 8:
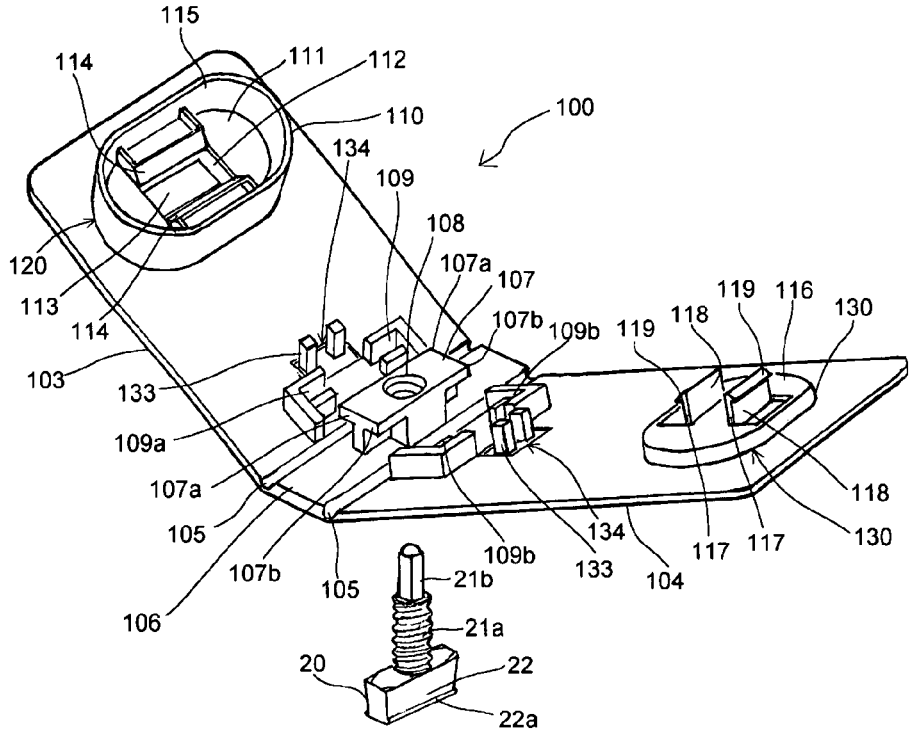
[FIG. 8] is a perspective view of the container fastener of the second embodiment.

Next, the container fastener according to the second embodiment is explained below with reference to FIG. 8. FIG. 8 is a perspective view of the container fastener of the second embodiment. As shown in FIG. 8, the container fastener of the second embodiment consists of the fastener body 100 and the key 20. Since the key 20 here is the same as the key 20 of the container fastener in the first embodiment, its explanation is omitted by assigning the same reference numerals.

A base member of the fastener body 100 is composed of a single plate having a substantially rectangular shape. In the base member, an inner side plate 103 and an outer side plate 104 are disposed and joined on both sides of a connecting portion 106 to form a pair of planar sections. Each of the outer side plate 104 and the inner side plate 103 interposes a hinge 105 so as to be folded on both sides of the connecting portion 106 provided at a central portion. On each of the inner side plate 103 and the outer side plate 104, fixing portions 120 and 130 which are to be fixed to the mounting holes 161 of the sleeve 160 are formed to project from positions which face each other when folding the fastener body 100 on both sides of the connecting portion. The connecting portion 106 is provided with a screw portion 107 for controlling advance and retraction of the key 20 on a surface thereof which comes to an inner side when folding the fastener body 100.

On each of the fixing portions 120 and 130 formed on an end side of each of the inner side plate 103 and the outer side plate 104, respectively, an inner engaging tab 113 and an outer engaging tab 117 are formed, respectively, which are to be fixed by elastically engaging with each other via the mounting hole 161 of the sleeve 160, respectively. The fixing portion 120 on the inner side plate 103 has a flange-shaped spacer 110 formed for keeping a distance from the outer side plate 104. The spacer 110 includes therein an intermediate wall 111 which has an opening portion 112 with a square C-shaped slot. In the opening portion 112, an inner engaging tab 113 having a rectangular shape is formed on a rear side of the intermediate wall 111 with a step. Claw guiding portions 114 comprising sloped surfaces which have been cut obliquely are formed on upper and lower sides of the opening portion 112 inside the intermediate wall 111.

In the fixing portion 130 on the outer side plate 104, a convex portion 116 which fits in a concave portion 115 inside the spacer 110 of the inner side plate 103 is formed. The convex portion 116 has a pair of outer engaging tabs 117 which are to be engaged with the opening portion 112 of the inner side plate 103. Each of the outer engaging tabs 117 is composed of an arm 118, which is disposed at a position corresponding to the opening portion 112 between the inner engaging tab 113 and the claw guiding portions 114, and a claw 119 that is formed outwardly on a tip end of the arm 118.

The screw portion 107 is provided with T-shaped pair arms 107*a* and 107*b* on both sides and an internal thread 108 for inserting the key 20 at a center thereof. On the inner side plate 103 and the outer side plate 104, fitting portions 109*a* and 109*b* which receive the T-shaped pair arms 107*a* and 107*b* are formed at positions corresponding to the screw portion 107. The screw portion 107 fits in the fitting portions 109*a* and 109*b* on the inner side plate 103 and the outer side plate 104 when folding the inner side plate 103 and the outer side plate 104 joined to the screw portion 107 via the hinge 105. Thus, a force applied on the connecting portion 106 is received by the screw portion 107 fitting in the fitting portions 109*a* and 109*b*, thereby preventing the force from acting on the hinge 105.

At an upper center of each of the fitting portions 109*a* and 109*b* on the inner side plate 103 and the outer side plate 104, a restricting portion 134 for preventing rotation of the key 20 is formed on each of the inner side plate 103 and the outer side plate 104. The restricting portion 134 has rectangular-rod-shaped restricting members 133 projecting from the inner side plate 103 and the outer side plate 104, which can prevent free rotation of the key 20 by elastically restricting the shank of the key 20. Here, the thickness of each plate at a foot portion of the restricting members 133 is smaller than the thickness of the surrounding area.

Figure 9:
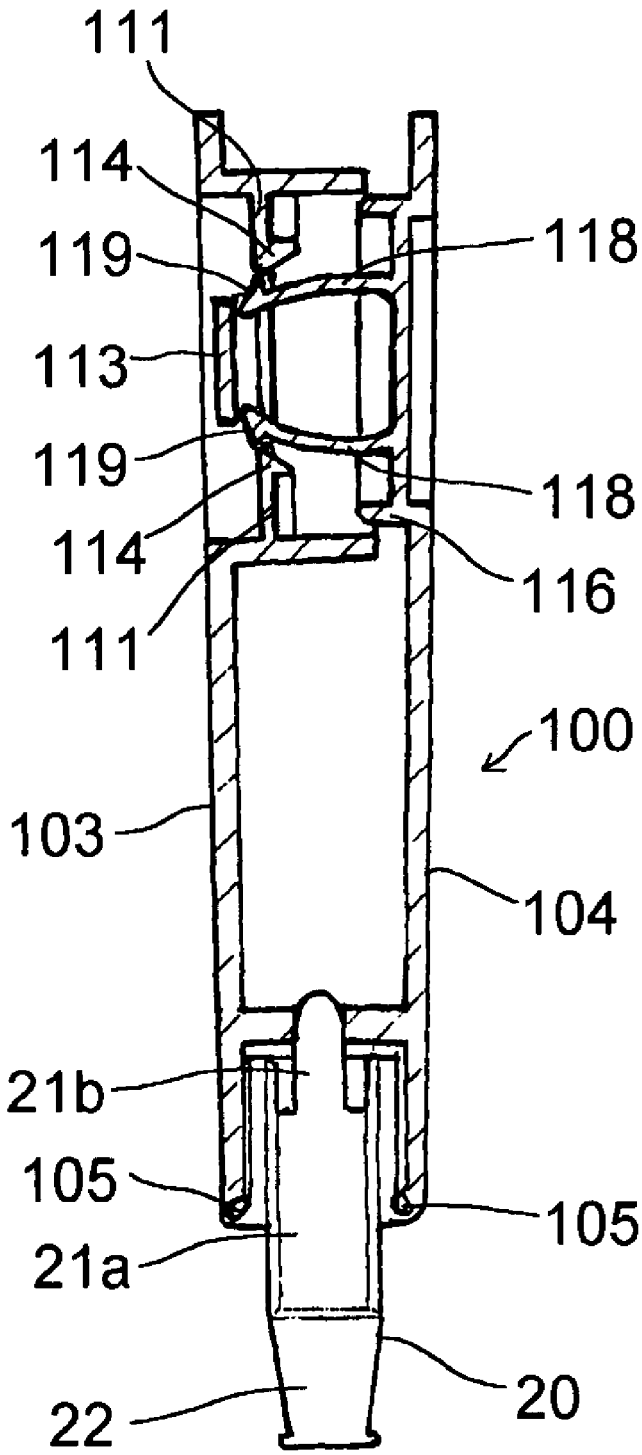
[FIG. 9] is a sectional view illustrating a fastening process of the container fastener of the second embodiment.
Figure 10:
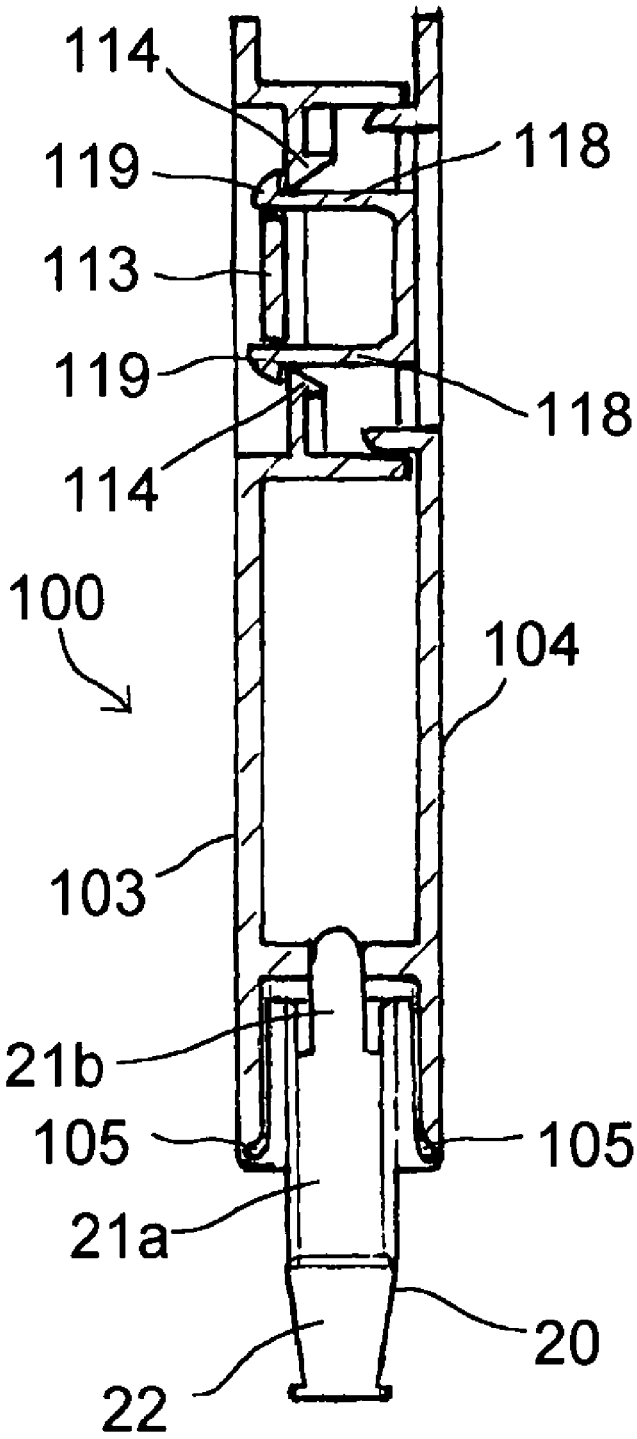
[FIG. 10] is a sectional view illustrating the container fastener of the second embodiment after fastening.
Figure 11:
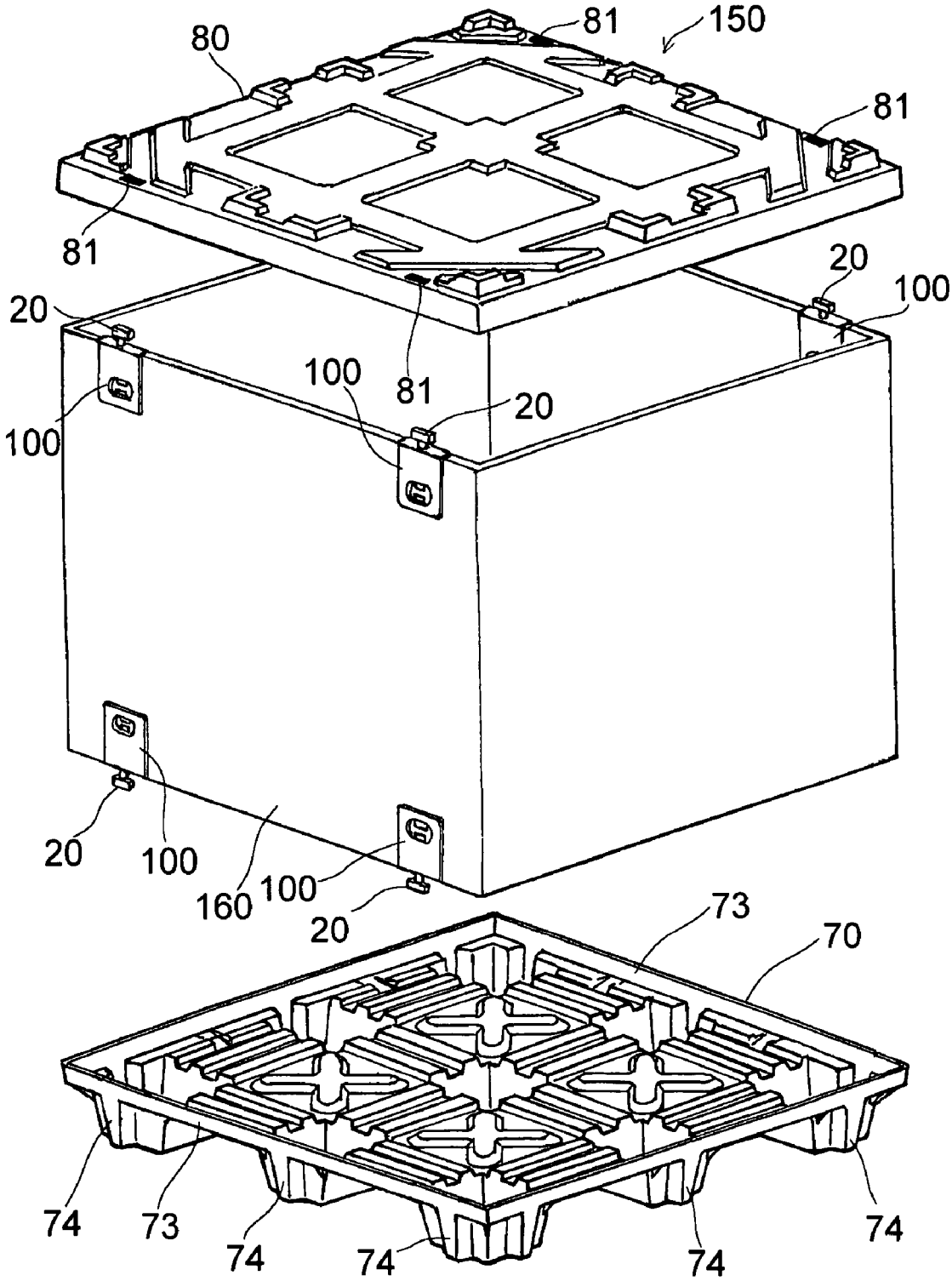
[FIG. 11] is a drawing illustrating the container fastener of the second embodiment fixed to the sleeve.
Figure 12:
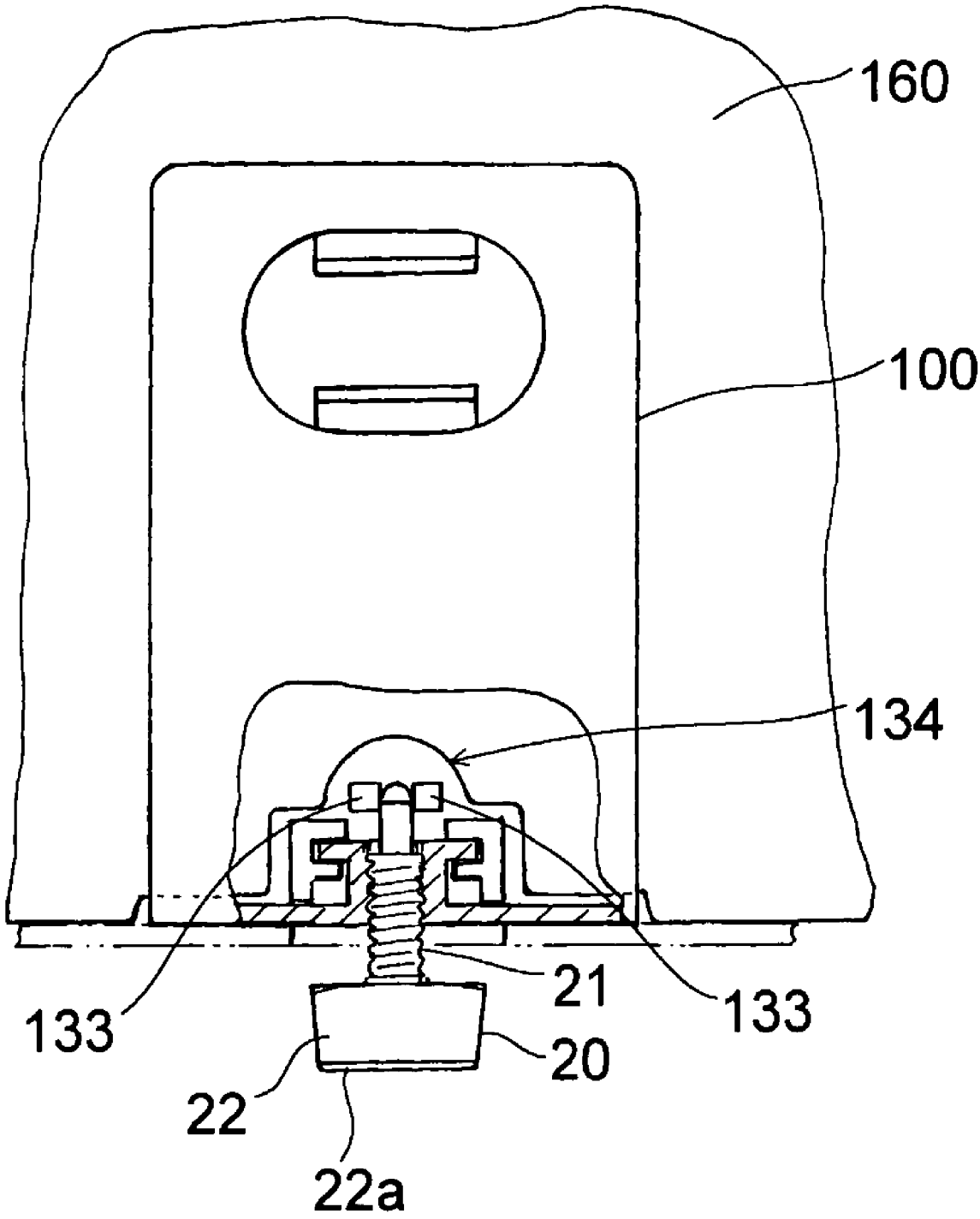
[FIG. 12] is a sectional view illustrating a main part of the sleeve and the pallet in a fastening process.
Figure 13:
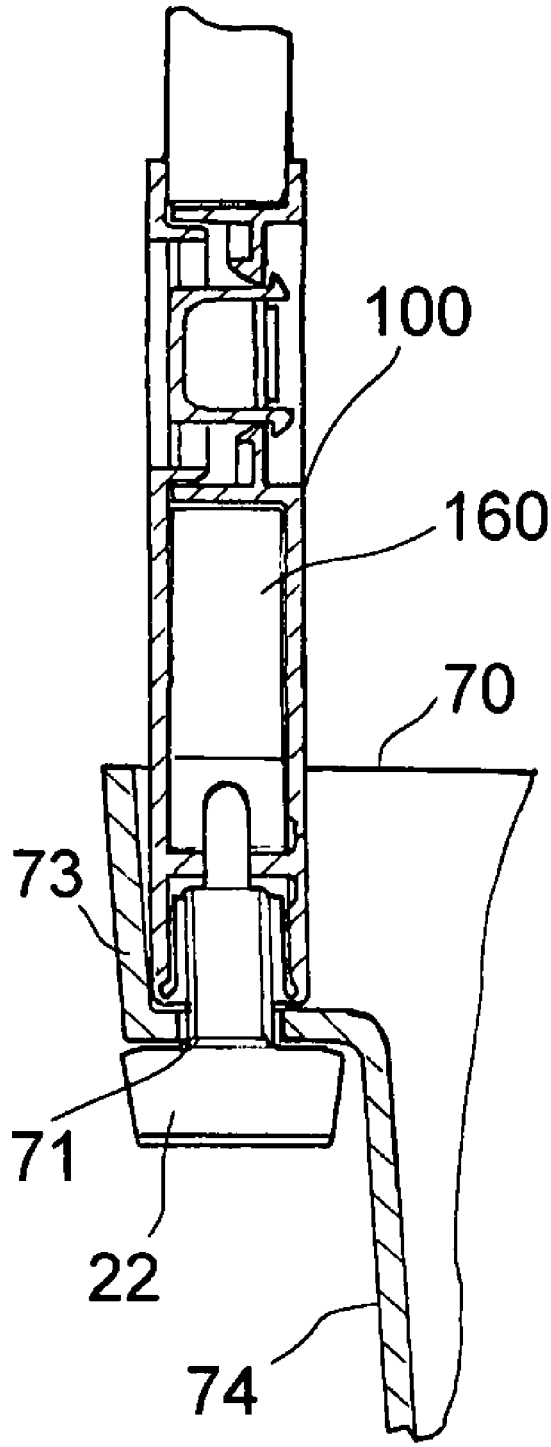
[FIG. 13] is a sectional view illustrating the sleeve and the pallet after fastening.

Next, a method of assembling the knockdown container 150 using the container fastener of the second embodiment is explained below with reference to the drawings. FIG. 9 is a sectional view illustrating a fastening process of the container fastener of the second embodiment; FIG. 10 is a sectional view illustrating the container fastener of the second embodiment after fastening; FIG. 11 is a drawing illustrating the container fastener of the second embodiment fixed to the sleeve; FIG. 12 is a sectional view illustrating a main part of the sleeve and the pallet in a fastening process; and FIG. 13 is a sectional view illustrating the sleeve and the pallet after fastening.

Firstly, the shank 21 of the key 20 is inserted into the internal thread 108 of the screw portion 107 of the fastener body 100 and fastened to the extent that the key 20 does not fall off the fastener body 100. Then, as shown in FIG. 7, by fitting the spacer 110 on the inner side plate 103 of the fastener body 100 into the mounting hole 161 of the sleeve 160, the restricting portion 134 and the fitting portions 109*a* and 109*b* fit in the notch 162. In this state, the inner side plate 103 and the outer side plate 104 are folded inwardly with the hinge 105 so that the T-shaped pair arms 107*a* and 107*b* of the screw portion 107 fit in the fitting portions 109*a* and 109*b* on the inner side plate 103 and the outer side plate 104.

At the same time, as shown in FIG. 9, the claws 119 formed at the tip ends of the pair of outer engaging tabs 117 of the outer side plate 104 abut the claw guiding portions 114 of the inner side plate 103. The arms 118 of the outer engaging tabs 117 are, while the claws 119 are being guided by the claw guiding portions 114, elastically deformed toward an inside of the opening portion 112. Simultaneously, the pair of outer engaging tabs 117 outwardly push and deform the inner engaging tab 113 of the opening portion 112. After the claws 119 pass through the opening portion 112, as shown in FIG. 10, the elastically deformed arms 118 return to their original state. Here, the inner engaging tab 113 pushed outward by the pair of outer engaging tabs 117 also recovers from the elastic deformation as shown in FIG. 10 and fits between arms 118 of the pair of outer engaging tabs 117. Thus, the pair of outer engaging tabs 117 are hooked on a rear side of the intermediate wall 111 with the claws 119 while the inner engaging tab 113 prevents the arms 118 from deforming inward, thereby completely locking the outer engaging tabs 117 onto the intermediate wall 111. The thus locked outer engaging tabs 117 are not released unless the inner engaging tab 113 is deformed with the fingertips and detached from the inside of the arms 118.

The sleeve 160 to which the fastener is mounted in the above-described manner is placed on the inner side of the sidewall 73 of the pallet 70. Here, as shown in FIG. 11, the rotation of the key 20 is adjusted so that the longitudinal direction of the knob 22 is in parallel to the base member of the fastener body 100, or that the knob 22 can be inserted into the connecting holes 71 formed on the pallet 70. Then, the knob 22 of the key 20 is inserted into the connecting holes 71 of the pallet 70 to project from the connecting holes 71 and, as shown in FIG. 12, the knob is rotated and tightened up by hands. Next, as shown in FIG. 13, the sleeve 160 and the pallet 70 are tightened up by rotating the knob 22 until the sleeve 160 and the pallet 70 are firmly connected without any play therebetween. In this stage, the shank 21 of the key 20 is restricted by the restricting members 133, of which function is the same as described in the first embodiment and thus the explanation is omitted. Then, the rotation stop position of the knob 22 is adjusted so that the knob 22 is perpendicular to the connecting holes 71, thereby fastening the sleeve 160 and the pallet 70. The sleeve 160 and the roof 80 are fastened in a similar manner.

As described above, according to the container fastener of the second embodiment, the container fastener can be easily attached to the sleeve 160 with a single operation and firmly fastened simply by inserting the spacer 110 on the inner side plate 103 of the fastener body 100 into the mounting hole 161 and the notch 162 formed on the sleeve 160 and folding and pushing the outer side plate 104 with the hinge 105. Furthermore, the fastener, once mounted, is locked by the inner engaging tab 113 and, therefore, does not fall out of the sleeve 160 unless the claws 119 of the outer engaging tabs 117 are broken. Upon detaching, the container fastener can be easily removed by deforming the inner engaging tab 113 with the fingertips to take off the inner engaging tab 113 from the inside of the arms 118. The inner engaging tab 113, which is formed on the rear side of the intermediate wall 111 with a step, can be easily deformed with the fingers. Consequently, no tool is necessary for attaching and detaching the container fastener of the second embodiment to/from the sleeve 160.

Preferably, the container fasteners of the first and second embodiments may be made of molded resin since the fasteners are engaged with other members by elastic deformation in their structures. However, it should not be particularly limited to the molded resin. The material used for the sleeves in the first and second embodiments is not limited; however, multilayered reinforced corrugated fiberboards may be preferable in view of the cost, durability, and folding operation necessary for reuse. It is further preferable that the pallets and the roofs be made of hot press molded boards obtained by recycling waste plastic and waste paper by crushing, mixing and solidifying the plastic and paper by hot press because of their low cost, high accuracy upon molding, and high strength.

INDUSTRIAL APPLICABILITY

The container fastener of the present invention is useful as a container fastener for fastening members constituting a knockdown container. In addition, the knockdown container using the container fastener can be easily assembled and disassembled and serves as a shipping container in which a sleeve and a pallet as well as a sleeve and a roof are firmly fastened and integrated.

The invention claimed is:

1. A container fastener comprising a fastener body which is mounted on a sleeve of a knockdown container provided with a pallet, a sleeve, and a roof and an auxiliary fastener which is incorporated into the fastener body to be advanceable to and retractable from the fastener body, in which a shank of the auxiliary fastener is held by the fastener body; a knob formed on a base end of the shank passes through or does not pass through a connecting hole formed on the pallet or the roof depending on a rotation stop position of the knob; and the pallet and the sleeve or the roof and the sleeve are connectable or separable depending on the rotation stop position of the knob of the auxiliary fastener, wherein the fastener body comprises a plate-like base member provided thereon with a fixing portion for fixing the fastener body to the sleeve through a mounting hole formed on the sleeve, a screw portion for controlling advance and retraction of the auxiliary fastener, and a restricting portion for preventing a rotation of the auxiliary fastener, the screw portion having an internal thread which corresponds to an external thread formed on the shank of the auxiliary fastener, and the restricting portion having a restricting member for preventing free rotation of the auxiliary fastener by elastically restricting a part of the shank, and the part of the shank of the auxiliary fastener has a form which corresponds to the restricting member of the fastener body.

2. The container fastener according to claim 1, wherein the base member is a single plate; the fixing portion has a fixing tab with an L-shaped section projecting from the plate, which hooks and is fixed to a lower edge of the mounting hole formed on the sleeve; and the restricting member projects from the plate in the restricting portion and has a flat surface which prevents free rotation of the auxiliary fastener by planar contact with a flat surface formed on the part of the shank of the auxiliary fastener.

3. The container fastener according to claim 1, wherein the base member of the fastener body is a plate which is foldable on both sides of a central portion of the base member; the fixing portion has engaging tabs projecting from a pair of planar sections which face each other when the plate is folded, the engaging tabs being elastically engaged with each other through a mounting hole formed on the sleeve and fixed to the sleeve; and the restricting member projects from the pair of planar sections in the restricting portion and has a flat surface which prevents free rotation of the auxiliary fastener by planar contact with a flat surface formed on the part of the shank of the auxiliary fastener.

4. The container fastener according to claim 2, wherein the shank of the auxiliary fastener has a flat surface formed on a front end side or a rear end side of the external thread, which corresponds to the flat surface of the restricting member of the base member.

5. The container fastener according to claim 3, wherein the shank of the auxiliary fastener has a flat surface formed on a front end side or a rear end side of the external thread, which corresponds to the flat surface of the restricting member of the base member.

6. A knockdown container comprising a pallet, a sleeve and a roof, wherein the sleeve has a mounting hole to which the fastener body according to claim 1 is mounted; at least one of either the pallet or the roof has a connecting hole through which the auxiliary fastener according to claim 1 passes; and at least one of either the pallet or the roof is attachable to or detachable from the sleeve with the container fastener according to claim 1.

7. A knockdown container comprising a pallet, a sleeve and a roof, wherein the sleeve has a mounting hole to which the fastener body according to claim 2 is mounted; at least one of either the pallet or the roof has a connecting hole through which the auxiliary fastener according to claim 2 passes; and at least one of either the pallet or the roof is attachable to or detachable from the sleeve with the container fastener according to claim 2.

8. A knockdown container comprising a pallet, a sleeve and a roof, wherein the sleeve has a mounting hole to which the fastener body according to claim 3 is mounted; at least one of either the pallet or the roof has a connecting hole through which the auxiliary fastener according to claim 3 passes; and at least one of either the pallet or the roof is attachable to or detachable from the sleeve with the container fastener according to claim 3.

9. A knockdown container comprising a pallet, a sleeve and a roof, wherein the sleeve has a mounting hole to which the fastener body according to claim 4 is mounted; at least one of either the pallet or the roof has a connecting hole through which the auxiliary fastener according to claim 4 passes; and at least one of either the pallet or the roof is attachable to or detachable from the sleeve with the container fastener according to claim 4.

10. A knockdown container comprising a pallet, a sleeve and a roof, wherein the sleeve has a mounting hole to which the fastener body according to claim 5 is mounted; at least one of either the pallet or the roof has a connecting hole through which the auxiliary fastener according to claim 5 passes; and at least one of either the pallet or the roof is attachable to or detachable from the sleeve with the container fastener according to claim 5.

* * * * *